US010070245B2

(12) United States Patent
Walsh et al.

(10) Patent No.: US 10,070,245 B2
(45) **Date of Patent: *Sep. 4, 2018**

(54) METHOD AND APPARATUS FOR PERSONALIZED AUDIO VIRTUALIZATION

(71) Applicant: DTS, Inc., Calabasas, CA (US)

(72) Inventors: Martin Walsh, Scotts Valley, CA (US); Edward Stein, Aptos, CA (US); Michael C. Kelly, London (GB); Prashant Velagaleti, San Francisco, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/242,141

(22) Filed: Aug. 19, 2016

(65) Prior Publication Data

US 2016/0360335 A1 Dec. 8, 2016

Related U.S. Application Data

(63) Continuation of application No. 14/091,112, filed on Nov. 26, 2013, now Pat. No. 9,426,599.

(Continued)

(51) Int. Cl.

| | |
|---|---|
| ***H04R 5/02*** | (2006.01) |
| ***H04S 7/00*** | (2006.01) |
| *H04S 3/00* | (2006.01) |

(52) U.S. Cl.

CPC ..... *H04S 7/305* (2013.01); *H04S 7/306* (2013.01); *H04S 7/307* (2013.01); *H04S 7/308* (2013.01);

(Continued)

(58) Field of Classification Search

CPC ..... H04S 7/305; H04S 7/306; H04S 7/307; H04S 7/308; H04S 3/008; H04S 7/304; H04S 2420/01

(Continued)

(56) References Cited

U.S. PATENT DOCUMENTS

| | | | |
|---|---|---|---|
| 2,511,482 | A | 6/1950 | Shaper |
| 3,745,674 | A | 7/1973 | Thompson et al. |

(Continued)

FOREIGN PATENT DOCUMENTS

| | | |
|---|---|---|
| EP | 1 089 526 | 4/2001 |
| EP | 2 124 479 | 11/2009 |

(Continued)

OTHER PUBLICATIONS

Search Report and Written Opinion issued in corresponding International Application No. PCT/US2013/072108; filed Nov. 26, 2013.

(Continued)

*Primary Examiner* — Paul S Kim
(74) *Attorney, Agent, or Firm* — Craig Fischer

(57) ABSTRACT

A method and apparatus may be used to perform personalized audio virtualization. The apparatus may include a speaker, a headphone (over-the-ear, on-ear, or in-ear), a microphone, a computer, a mobile device, a home theater receiver, a television, a Blu-ray (BD) player, a compact disc (CD) player, a digital media player, or the like. The apparatus may be configured to receive an audio signal, scale the audio signal, and perform a convolution and reverberation on the scaled audio signal to produce a convolved audio signal. The apparatus may be configured to filter the convolved audio signal and process the filtered audio signal for output.

30 Claims, 7 Drawing Sheets

Related U.S. Application Data

(60) Provisional application No. 61/731,958, filed on Nov. 30, 2012, provisional application No. 61/749,746, filed on Jan. 7, 2013.

(52) U.S. Cl.
CPC ..... *H04S 3/008* (2013.01); *H04S 7/304* (2013.01); *H04S 2420/01* (2013.01)

(58) Field of Classification Search
USPC ..... 381/303, 17, 58, 300, 309, 310
See application file for complete search history.

(56) References Cited

U.S. PATENT DOCUMENTS 3,808,354 A 4/1974 Feezor et al.
3,809,811 A 5/1974 Delisle et al.
4,107,465 A 8/1978 Charlebois et al.
4,284,847 A 8/1981 Besserman
4,476,724 A 10/1984 Gotze
4,862,505 A 8/1989 Keith et al.
4,868,880 A 9/1989 Bennett, Jr.
5,033,086 A 7/1991 Fidi
5,438,623 A 8/1995 Begault
5,737,389 A 4/1998 Allen et al.
5,785,661 A 7/1998 Shennib
5,825,894 A 10/1998 Shennib
5,870,481 A 2/1999 Dymond et al.
6,086,541 A 7/2000 Rho
6,109,107 A 8/2000 Wright et al.
6,144,747 A 11/2000 Scofield et al.
6,167,138 A 12/2000 Shennib
6,212,496 B1 4/2001 Campbell et al.
6,319,207 B1 11/2001 Naidoo
6,322,521 B1 11/2001 Hou
6,343,131 B1 1/2002 Huopanieme
6,379,314 B1 4/2002 Horn
6,428,485 B1 8/2002 Rho
6,457,362 B1 10/2002 Wright et al.
6,522,988 B1 2/2003 Hou
6,582,378 B1 6/2003 Nakaichi et al.
6,584,440 B2 6/2003 Litovsky
6,644,120 B1 11/2003 Braun et al.
6,707,918 B1 3/2004 McGrath et al.
6,724,862 B1 4/2004 Shaffer et al.
6,741,706 B1 5/2004 McGrath et al.
6,801,627 B1 10/2004 Kobayashi
6,813,490 B1 11/2004 Lang et al.
6,829,361 B2 12/2004 Aarts
6,840,908 B2 1/2005 Edwards et al.
6,913,578 B2 7/2005 Hou
6,928,179 B1 8/2005 Yamada et al.
6,970,569 B1 11/2005 Yamada
7,042,986 B1 5/2006 Lashley et al.
7,048,692 B2 5/2006 Nakaichi et al.
7,133,730 B1 11/2006 Katayama et al.
7,136,492 B2 11/2006 Moller
7,143,031 B1 11/2006 Ahroon
7,149,684 B1 12/2006 Ahroon
7,152,082 B2 12/2006 McGrath
7,162,047 B2 1/2007 Yamada et al.
7,167,571 B2 1/2007 Bantz et al.
7,181,297 B1 2/2007 Pluvinage et al.
7,184,557 B2 2/2007 Berson
7,190,795 B2 3/2007 Simon
7,206,416 B2 4/2007 Krause et al.
7,210,353 B2 5/2007 Braun et al.
7,221,765 B2 5/2007 Chaluipper et al.
7,330,552 B1 2/2008 Lamance
7,333,863 B1 2/2008 Lydecker et al.
7,366,307 B2 4/2008 Yang et al.
7,386,140 B2 6/2008 Ogata
7,529,545 B2 5/2009 Rader et al.
7,536,021 B2 5/2009 Dickins et al.
7,539,319 B2 5/2009 Dickins et al.
7,564,979 B2 7/2009 Swartz
7,634,092 B2 12/2009 McGrath
7,680,465 B2 3/2010 Zad-Issa
7,715,575 B1 5/2010 Sakurai et al.
7,773,755 B2 8/2010 Terauchi
7,793,545 B2 9/2010 Mayou et al.
7,826,630 B2 11/2010 Yamada et al.
7,876,908 B2 1/2011 Hensel
7,933,419 B2 4/2011 Roeck et al.
7,936,887 B2 5/2011 Smyth
7,936,888 B2 5/2011 Kwon
7,949,141 B2 5/2011 Reilly et al.
7,978,866 B2 7/2011 Oteki
8,009,836 B2 8/2011 McGrath
8,059,833 B2 11/2011 Koh et al.
8,064,624 B2 11/2011 Naugebauer et al.
8,112,166 B2 2/2012 Pavlovic et al.
8,130,989 B2 3/2012 Latzel
8,135,138 B2 3/2012 Wessel et al.
8,144,902 B2 3/2012 Johnston
8,160,281 B2 4/2012 Kim et al.
8,161,816 B2 4/2012 Beck
8,166,312 B2 4/2012 Waldmann
8,195,453 B2 6/2012 Cornell et al.
8,196,470 B2 6/2012 Gross
8,284,946 B2 10/2012 Moon et al.
8,340,303 B2 12/2012 Chun
9,426,599 B2 8/2016 Walsh et al.
2002/0068986 A1 6/2002 Mouline
2002/0076072 A1 6/2002 Cornelise
2003/0028385 A1 2/2003 Christodoulou
2003/0070485 A1 4/2003 Johansen et al.
2003/0072455 A1 4/2003 Johansen et al.
2003/0073926 A1 4/2003 Johansen et al.
2003/0073927 A1 4/2003 Johansen et al.
2003/0101215 A1 5/2003 Puria et al.
2003/0123676 A1 7/2003 Schobben
2003/0223603 A1 12/2003 Beckman
2004/0049125 A1 3/2004 Nakamura
2005/0124375 A1 6/2005 Nowosielski
2005/0135644 A1 6/2005 Qi
2005/0148900 A1 7/2005 Braun et al.
2006/0045281 A1 3/2006 Korneluk
2006/0215844 A1 9/2006 Voss
2007/0003077 A1 1/2007 Pedersen et al.
2007/0071263 A1 3/2007 Beck
2007/0129649 A1 6/2007 Thornton et al.
2007/0189545 A1 8/2007 Gelger et al.
2007/0204696 A1 9/2007 Braun et al.
2008/0008328 A1 1/2008 Hansson
2008/0049946 A1 2/2008 Heller et al.
2008/0167575 A1 7/2008 Cronin et al.
2008/0269636 A1 10/2008 Burrows et al.
2008/0279401 A1 11/2008 Bharikar et al.
2009/0013787 A1 1/2009 Esnof
2009/0116657 A1 5/2009 Edwards et al.
2009/0156959 A1 6/2009 Thornton et al.
2009/0268919 A1 10/2009 Arora
2010/0056950 A1 3/2010 Banerjee et al.
2010/0056951 A1 3/2010 Banerjee et al.
2010/0098262 A1 4/2010 Frohlich
2010/0106508 A1 4/2010 Malesky, II
2010/0119093 A1 5/2010 Uzuanis et al.
2010/0137739 A1 6/2010 Lee et al.
2010/0166238 A1 7/2010 Lee et al.
2010/0183161 A1 7/2010 Boretzki
2010/0191143 A1 7/2010 Ganter et al.
2010/0272297 A1 10/2010 Boretzki
2010/0280409 A1 11/2010 Mark
2010/0310101 A1 12/2010 Anderson
2010/0316227 A1 12/2010 Schmid
2010/0329490 A1 12/2010 Schijndel et al.
2011/0009771 A1 1/2011 Guillon et al.
2011/0046511 A1 2/2011 Koo et al.
2011/0075853 A1 3/2011 Anderson et al.
2011/0190658 A1 8/2011 Sohn et al.
2011/0219879 A1 9/2011 Chalupper et al.
2011/0305358 A1 12/2011 Nishio et al.
2012/0051569 A1 3/2012 Blamey et al.

(56) References Cited

U.S. PATENT DOCUMENTS

| | | | | |
|---|---|---|---|---|
| 2012/0057715 | A1* | 3/2012 | Johnston | G10L 19/008 381/63 |
| 2012/0063616 | A1* | 3/2012 | Walsh | H03G 5/025 381/103 |
| 2012/0099733 | A1* | 4/2012 | Wang | H04S 1/002 381/17 |
| 2012/2034521 | | 5/2012 | Wessel et al. | |
| 2012/0157876 | A1 | 6/2012 | Bankg et al. | |
| 2012/0288124 | A1 | 11/2012 | Fejzo et al. | |
| 2014/0270185 | A1 | 8/2014 | Walsh | |

FOREIGN PATENT DOCUMENTS

| | | |
|---|---|---|
| WO | WO97/25834 | 7/1997 |
| WO | WO2011/024576 | 4/2001 |
| WO | WO2004/039126 | 5/2004 |
| WO | WO2004/104761 | 12/2004 |
| WO | WO2006/002036 | 1/2006 |
| WO | WO2006/007632 | 1/2006 |
| WO | WO2006/136174 | 12/2006 |
| WO | WO2010/017156 | 2/2010 |
| WO | WO2010/139760 | 12/2010 |
| WO | WO2011/014906 | 2/2011 |
| WO | WO2011/026908 | 3/2011 |
| WO | WO2012/016527 | 2/2012 |
| WO | WO2014/085510 | 5/2014 |

OTHER PUBLICATIONS

International Preliminary Report on Patentability issued in corresponding International Application No. PCT/US2013/072108; filed Nov. 26, 2013.

Arthur Boothroyd, Laurie Hanin, Eddy Yeung, Qi-You Chen, Videogame for Speech Perception Testing and Training of Young Hearing-impaired Children, Jan. 1992, Graduate School, City of University of New York.

NinaDvorko, Konstantin Ershow, "Audio-visual perception of video and multimedia programs," Audio Engineering Society, presented at the 21st Conference, Jun. 1-3, 2002, St. Petersburg, Russia.

John Usher, Wieslaw Woszczyk, "Visualizing auditory spatial imagery of multi-channel audio," Audio Engineering Society, Presented at the 116th Convention, May 8-11, 2004, Berlin, Germany.

Office Action in corresponding Chinese Patent Application No. 201380069148.4, dated May 9, 2016, including English translation, 12 pages.

* cited by examiner

METHOD AND APPARATUS FOR PERSONALIZED AUDIO VIRTUALIZATION

CROSS REFERENCE TO RELATED APPLICATIONS

This application is a continuation application of U.S. patent application Ser. No. 14/091,112, filed on Nov. 26, 2013, which claims the benefit of U.S. Provisional Application No. 61/731,958, filed on Nov. 30, 2012 and U.S. Provisional Application No. 61/749,746, filed on Jan. 7, 2013, which are incorporated by reference as if fully set forth.

BACKGROUND

In traditional audio reproduction, consumers are unable to reproduce the spatial attributes of the original content producer or device manufacturer. Accordingly, the intent of the original content producer is lost, and the consumer is left with an undesirable audio experience. It would therefore be desirable to have a method and apparatus to deliver a high quality audio production that conveys the original intent of the content producer delivered to the consumer.

SUMMARY

A brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

Various exemplary embodiments relate to a method and apparatus for performing a personalized audio virtualization. The apparatus may include a speaker, a headphone (over-the-ear, on-ear, or in-ear), a microphone, a computer, a mobile device, a home theater receiver, a television, a Blu-ray (BD) player, a compact disc (CD) player, a digital media player, or the like. The apparatus may be configured to receive an audio signal, scale the audio signal, and perform a convolution and reverberation on the scaled audio signal to produce a convolved audio signal. The apparatus may be configured to filter the convolved audio signal and process the filtered audio signal for output.

Various exemplary embodiments further relate to a method for use in an audio device, the method including: receiving digital audio content that contains at least one audio channel signal; receiving metadata that influences the reproduction of the digital audio content, wherein the metadata includes a room measurement profile based on acoustic measurements of a predetermined room and a listener hearing profile based on a spectral response curve of a user hearing ability; configuring at least one digital filter based on the received metadata; filtering the at least one audio channel with the corresponding at least one digital filter to produce a filtered audio signal; and outputting the filtered audio signal to an accessory device.

In some embodiments, the metadata further includes a playback device profile based on a frequency response parameter of a playback device, and an accessory device profile based on a frequency response parameter of an accessory device. In some embodiments, the metadata is received multiplexed with the digital audio content. In some embodiments, the metadata is received in a container file separately from the digital audio content. In some embodiments, the room measurement profile includes at least a set of head-related transfer function (HRTF) filter coefficients, an early room response parameter, and a late reverberation parameter. In some embodiments, the early room response parameter and the late reverberation parameter configure the digital filter to produce a filtered audio signal having acoustic properties substantially similar to the acoustic properties of the predetermined room. In some embodiments, the late reverberation parameter configures a parametric model of the late reverberation of the predetermined room.

Various exemplary embodiments further relate to an audio device that includes: a receiver configured to receive digital audio content that contains at least one audio channel signal; and receive metadata that influences the reproduction of the digital audio content, wherein the metadata includes a room measurement profile based on acoustic measurements of a predetermined room and a listener hearing profile based on a spectral response curve of a user hearing ability; a processor configured to configure at least one digital filter based on the received metadata, wherein the processor is configured to filter the at least one audio channel signal with the corresponding at least one digital filter to produce a filtered audio signal; and wherein the processor is configured to output the filtered audio signal to an accessory device.

In some embodiments, the metadata further includes a playback device profile based on a frequency response parameter of a playback device, and an accessory device profile based on a frequency response parameter of an accessory device. In some embodiments, the metadata is received multiplexed with the digital audio content. In some embodiments, the metadata is received in a container file separately from the digital audio content. In some embodiments, the room measurement profile includes at least a set of head-related transfer function (HRTF) filter coefficients, an early room response parameter, and a late reverberation parameter. In some embodiments, the processor utilizes the early room response parameter and the late reverberation parameter to configure the digital filter to produce a filtered audio signal having acoustic properties substantially similar to the acoustic properties of the predetermined room. In some embodiments, the processor utilizes the late reverberation parameter to configure a parametric model of the late reverberation of the predetermined room.

Various exemplary embodiments further relate to a virtualization data format that includes: a plurality of fields that include a plurality of parameters, wherein the plurality of parameters are based on a room measurement profile based on acoustic measurements of a predetermined room, a listener hearing profile based on a spectral response curve of a user hearing ability, a playback device profile based on a frequency response parameter of a playback device, and an accessory device profile based on a frequency response parameter of an accessory device.

In some embodiments, at least one of the plurality of parameters is multiplexed with digital audio content.

Various exemplary embodiments further relate to a method for use in an audio device, the method including: receiving digital audio content that contains at least one audio channel signal; receiving metadata that influences the reproduction of the digital audio content, wherein the metadata includes a room measurement profile based on acoustic measurements of a predetermined room; configuring at least one digital filter based on the received metadata; filtering the at least one audio channel with the corresponding at least one digital filter to produce a filtered audio signal; and outputting the filtered audio signal to an accessory device.

In some embodiments, the metadata further includes a playback device profile based on a frequency response parameter of a playback device, and an accessory device profile based on a frequency response parameter of an accessory device. In some embodiments, the metadata is received multiplexed with the digital audio content. In some embodiments, the metadata is received in a container file separately from the digital audio content. In some embodiments, the room measurement profile includes at least a set of head-related transfer function (HRTF) filter coefficients, an early room response parameter, and a late reverberation parameter. In some embodiments, the early room response parameter and the late reverberation parameter configure the digital filter to produce a filtered audio signal having acoustic properties substantially similar to the acoustic properties of the predetermined room. In some embodiments, the late reverberation parameter configures a parametric model of the late reverberation of the predetermined room.

Various exemplary embodiments further relate to an audio device that includes: a receiver configured to receive digital audio content that contains at least one audio channel signal; and receive metadata that influences the reproduction of the digital audio content, wherein the metadata includes a room measurement profile based on acoustic measurements of a predetermined room; a processor configured to configure at least one digital filter based on the received metadata, wherein the processor is configured to filter the at least one audio channel signal with the corresponding at least one digital filter to produce a filtered audio signal; and wherein the processor is configured to output the filtered audio signal to an accessory device.

In some embodiments, the metadata further includes a playback device profile based on a frequency response parameter of a playback device, and an accessory device profile based on a frequency response parameter of an accessory device. In some embodiments, the metadata is received multiplexed with the digital audio content. In some embodiments, the metadata is received in a container file separately from the digital audio content. In some embodiments, the room measurement profile includes at least a set of head-related transfer function (HRTF) filter coefficients, an early room response parameter, and a late reverberation parameter. In some embodiments, the processor utilizes the early room response parameter and the late reverberation parameter to configure the digital filter to produce a filtered audio signal having acoustic properties substantially similar to the acoustic properties of the predetermined room. In some embodiments, the processor utilizes the late reverberation parameter to configure a parametric model of the late reverberation of the predetermined room.

In some embodiments, the digital audio content includes a flag that indicates that the audio channel signal contains pre-processed content. If the audio channel signal was pre-processed, the metadata may include information on how the audio signal was pre-processed.

In some embodiments, the metadata includes a flag that indicates that the digital audio content contains at least one pre-processed audio channel signal. If the audio channel signal was pre-processed, the metadata may include information on how the audio signal was pre-processed.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
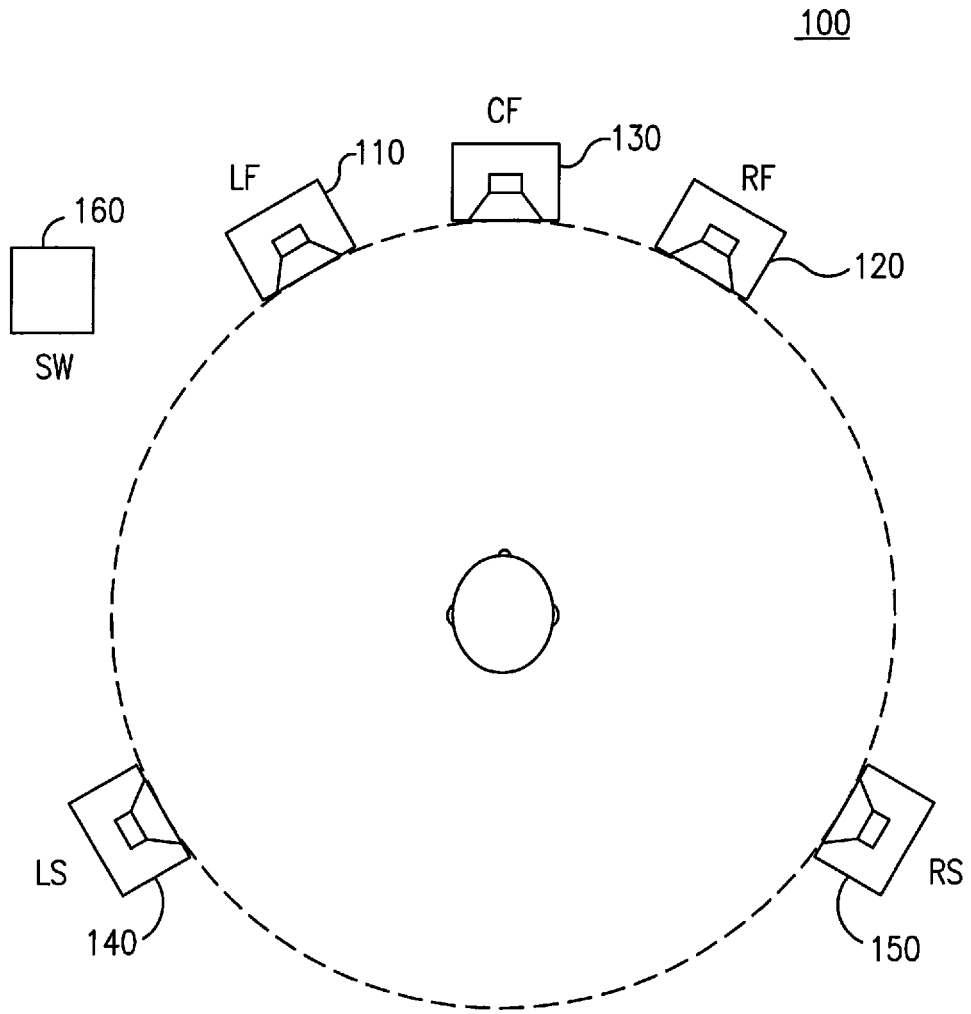
FIG. 1 is a diagram of an example loudspeaker arrangement in a traditional 5.1 surround format.

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment. It is to be understood, however, that the same or equivalent functions and sequences may be accomplished by different embodiments that are also intended to be encompassed within the spirit and scope of the invention. It is further understood that the use of relational terms such as first and second, and the like are used solely to distinguish one entity from another entity without necessarily requiring or implying any actual such relationship or order between such entities.

A sound wave is a type of pressure wave caused by the vibration of an object that propagates through a compressible medium such as air. A sound wave periodically displaces matter in the medium (e.g. air) causing the matter to oscillate. The frequency of the sound wave describes the number of complete cycles within a period of time and is expressed in Hertz (Hz). Sound waves in the 12 Hz to 20,000 Hz frequency range are audible to humans.

The present application concerns a method and apparatus for processing audio signals, which is to say signals representing physical sound. These signals may be represented by digital electronic signals. In the discussion which follows, analog waveforms may be shown or discussed to illustrate the concepts; however, it should be understood that typical embodiments of the invention may operate in the context of a time series of digital bytes or words, said bytes or words forming a discrete approximation of an analog signal or (ultimately) a physical sound. The discrete, digital signal may correspond to a digital representation of a periodically sampled audio waveform. As is known in the art, for uniform sampling, the waveform may be sampled at a rate at least sufficient to satisfy the Nyquist sampling theorem for the frequencies of interest. For example, in a typical embodiment a uniform sampling rate of approximately 44.1 kHz may be used. Higher sampling rates such as 96 kHz may alternatively be used. The quantization scheme and bit resolution may be chosen to satisfy the requirements of a particular application, according to principles well known in the art. The techniques and apparatus of the invention typically would be applied interdependently in a number of channels. For example, it may be used in the context of a "surround" audio system (having more than two channels).

As used herein, a "digital audio signal" or "audio signal" does not describe a mere mathematical abstraction, but instead denotes information embodied in or carried by a physical medium capable of detection by a machine or apparatus. This term includes recorded or transmitted signals, and should be understood to include conveyance by any form of encoding, including pulse code modulation (PCM), but not limited to PCM. Outputs or inputs, or indeed intermediate audio signals may be encoded or compressed by any of various known methods, including MPEG, ATRAC, AC3, or the proprietary methods of DTS, Inc. as described in U.S. Pat. Nos. 5,974,380; 5,978,762; and 6,487,535. Some modification of the calculations may be required to accommodate that particular compression or encoding method, as will be apparent to those with skill in the art.

The present invention may be implemented in a consumer electronics device, such as a Digital Video Disc (DVD) or Blu-ray Disc (BD) player, television (TV) tuner, Compact Disc (CD) player, handheld player, Internet audio/video device, a gaming console, a mobile phone, or the like. A consumer electronic device includes a Central Processing Unit (CPU) or Digital Signal Processor (DSP), which may represent one or more conventional types of such processors, such as an IBM PowerPC, Intel Pentium (x86) processors, and so forth. A Random Access Memory (RAM) temporarily stores results of the data processing operations performed by the CPU or DSP, and is interconnected thereto typically via a dedicated memory channel. The consumer electronic device may also include permanent storage devices such as a hard drive, which are also in communication with the CPU or DSP over an I/O bus. Other types of storage devices such as tape drives, optical disk drives may also be connected. A graphics card is also connected to the CPU via a video bus, and transmits signals representative of display data to the display monitor. External peripheral data input devices, such as a keyboard or a mouse, may be connected to the audio reproduction system over a USB port. A USB controller translates data and instructions to and from the CPU for external peripherals connected to the USB port. Additional devices such as printers, microphones, speakers, and the like may be connected to the consumer electronic device.

The consumer electronic device may utilize an operating system having a graphical user interface (GUI), such as WINDOWS from Microsoft Corporation of Redmond, Wash., MAC OS from Apple, Inc. of Cupertino, Calif., various versions of mobile GUIs designed for mobile operating systems such as Android, and so forth. The consumer electronic device may execute one or more computer programs. Generally, the operating system and computer programs are tangibly embodied in a computer-readable medium, e.g. one or more of the fixed and/or removable data storage devices including the hard drive. Both the operating system and the computer programs may be loaded from the aforementioned data storage devices into the RAM for execution by the CPU. The computer programs may comprise instructions which, when read and executed by the CPU, cause the same to perform the steps to execute the steps or features of the present invention.

The present invention may have many different configurations and architectures. Any such configuration or architecture may be readily substituted without departing from the scope of the present invention. A person having ordinary skill in the art will recognize the above described sequences are the most commonly utilized in computer-readable mediums, but there are other existing sequences that may be substituted without departing from the scope of the present invention.

Elements of one embodiment of the present invention may be implemented by hardware, firmware, software or any combination thereof. When implemented as hardware, the audio codec may be employed on one audio signal processor or distributed amongst various processing components. When implemented in software, the elements of an embodiment of the present invention may be the code segments to perform various tasks. The software may include the actual code to carry out the operations described in one embodiment of the invention, or code that may emulate or simulate the operations. The program or code segments can be stored in a processor or machine accessible medium or transmitted by a computer data signal embodied in a carrier wave, or a signal modulated by a carrier, over a transmission medium. The "processor readable or accessible medium" or "machine readable or accessible medium" may include any medium configured to store, transmit, or transfer information.

Examples of the processor readable medium may include an electronic circuit, a semiconductor memory device, a read only memory (ROM), a flash memory, an erasable ROM (EROM), a floppy diskette, a compact disk (CD) ROM, an optical disk, a hard disk, a fiber optic medium, a radio frequency (RF) link, etc. The computer data signal includes any signal that may propagate over a transmission medium such as electronic network channels, optical fibers, air, electromagnetic, RF links, etc. The code segments may be downloaded via computer networks such as the Internet, Intranet, etc. The machine accessible medium may be embodied in an article of manufacture. The machine accessible medium may include data that, when accessed by a machine, may cause the machine to perform the operation described in the following. The term "data" here refers to any type of information that may be encoded for machine-readable purposes. Therefore, it may include program, code, data, file, etc.

All or part of an embodiment of the invention may be implemented by software. The software may have several modules coupled to one another. A software module may be coupled to another module to receive variables, parameters, arguments, pointers, etc. and/or to generate or pass results, updated variables, pointers, etc. A software module may also be a software driver or interface to interact with the operating system running on the platform. A software module may also be a hardware driver to configure, set up, initialize, send and receive data to and from a hardware device.

One embodiment of the invention may be described as a process which is usually depicted as a flowchart, a flow diagram, a structure diagram, or a block diagram. Although a block diagram may describe the operations as a sequential process, many of the operations may be performed in parallel or concurrently. In addition, the order of the operations may be re-arranged. A process may be terminated when its operations are completed. A process may correspond to a method, a program, a procedure, etc.

Particular embodiments of the present invention may utilize acoustic room measurements. The measurements may be taken in rooms containing high fidelity audio equipment, such as, for example, a mixing studio or a listening room. The room may include multiple loudspeakers, and the loudspeakers may be arranged in traditional speaker layouts, such as, for example, stereo, 5.1, 7.1, 11.1, or 22.2. Other speaker layouts or arrays may also be used, such as wave field synthesis (WFS) arrays or other object-based rendering layouts.

FIG. 1 is a diagram of an example loudspeaker arrangement 100 in a traditional 5.1 surround format. The loudspeaker arrangement 100 may include a left front loudspeaker 110, a right front loudspeaker 120, a center front loudspeaker 130, a left surround loudspeaker 140, a right surround loudspeaker 150, and a subwoofer 160. While a mixing studio having surround loudspeakers is provided as an example, the measurements may be taken in any location containing one or more loudspeakers.

Room Acoustics

Figure 2:
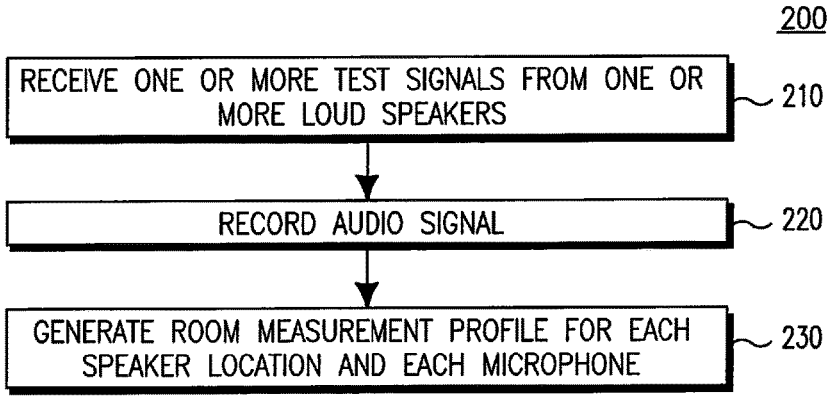
FIG. 2 is a diagram of an example room acoustics measurement procedure.

FIG. 2 is a diagram of an example room acoustics measurement procedure 200. In this example, the acoustic room measurements may be obtained by placing a measurement apparatus in an optimal listening position, such as a producer's chair. The measurement apparatus may be a free-standing microphone, binaural microphones placed within a dummy head, or binaural microphones placed within a test subject's ears. The measurement apparatus may receive one or more test signals from one or more loudspeakers 210. The test signals may include a frequency sweep or chirp signal. Alternatively, or in addition, a test signal may be a noise sequence such as a Golay code or a maximum length sequence. As each loudspeaker plays the test signal, the measurement apparatus may record the audio signal 220 received at the listening position. From the recorded audio signals, a room measurement profile may be generated 230 for each speaker location and each microphone of the measurement apparatus.

In accordance with a particular embodiment, the measurement apparatus may be rotatable. Additional test tones may be played with the measurement apparatus rotated in various positions. The measurement information at the various rotations may allow the system to support head-tracking of a listener, as described below.

Additional room measurements may be taken at other locations in the room, for example, for "out of sweetspot" monitoring. The "out of sweetspot" measurements may aid in determining the acoustics of the measured room for listeners not in the optimal listening position.

Additionally, in accordance with a particular embodiment, the frequency response of specific playback headphones may be obtained with the measurement apparatus.

In accordance with a particular novel embodiment, each measured room measurement profile may be separated into a head-related transfer function (HRTF), an early room response, and a late reverberation. The HRTFs may characterize how the measurement apparatus received the sound from each loudspeaker without the acoustic effects of the room. The early room response may characterize the early reflections after the sound from each loudspeaker has reflected off the surfaces of the room. The late reverberation may characterize the sound in the room after the early reflections.

The HRTFs may be represented by filter coefficients. For example, the early room response and late reverberation may be represented by acoustic models that recreate the acoustics of the room. The acoustic models may be determined in part by early room response parameters and late reverberation parameters. The acoustic models may be transmitted and/or stored as a room measurement profile.

In accordance with a particular novel embodiment, the HRTF filter coefficients, early room response parameters, and/or late reverberation parameters may be used for processing an audio signal for playback over headphones. Alternatively, in another embodiment, the full room measurement profiles may be used for processing the audio signal. The audio signal may be processed so that the acoustics and loudspeaker locations of the measured room are recreated when the signal is played back over headphones.

The early room response and late reverberation acoustic models may not precisely recreate the acoustics of the room. Therefore, in accordance with a particular novel embodiment, the acoustic models and/or parameters may be modified to apply virtual acoustic treatments to the room or equalizations (EQs) to the loudspeakers. The virtual acoustic measurements may include virtual absorption treatments or virtual bass traps. The virtual absorption treatments may "deaden" the room reverberation response or modify the sound reflected off certain surfaces. The virtual bass traps may remove some of the "boominess" of the room. EQs may be applied to modify the perceived frequency response of each loudspeaker in the room.

The room measurement profile may include the full room measurement profile data and/or the HRTF filter coefficients, early room response parameters, and late reverberation parameters for one or more rooms and one or more listening positions within each room. The room measurement profile may further include other identifying information such as headphone frequency response information, headphone identification information, measured loudspeaker layout information, playback mode information, measurement location information, measurement equipment information, and/or licensing/ownership information.

In accordance with a particular novel embodiment, virtualization data may be stored as metadata that may be included in an audio content bitstream. The audio content may be channel based or object based. The virtualization data may include at least one of a room measurement profile, a playback device profile, an accessory device profile, and a listener hearing profile. The room measurement profile may include room response parameters and HRTFs. In some embodiments, the room measurement profile may not include HRTFs. The playback device profile may include the frequency response parameters of a playback device and other playback device information. A playback device may be any device that converts audio data to a signal that may be rendered by speakers, including headphones. The accessory device profile may include the frequency response parameters of an accessory device, for example, a headphone, and other accessory device information. An accessory device may be any device that converts the audio signal from the playback device into an audible sound. The playback device and the accessory device may be the same device in embodiments where the headphones/speakers include the necessary DACs, amplifiers, and virtual processors. The listener hearing profile may include listener hearing loss parameters, listener equalization preferences, and HRTFs.

The virtualization data may be embedded or multiplexed in a file header of the audio content, or in any other portion of an audio file or frame. The virtualization data may also be repeated in multiple frames of the audio bitstream. Alternatively or in addition, the virtualization data may be adapted in time over several frames, or may be stored in a virtualization data file separate from the audio content. The virtualization data may be transferred to the virtualization system with the audio content or the virtualization data may be transferred separately from the audio content.

Figure 3A:
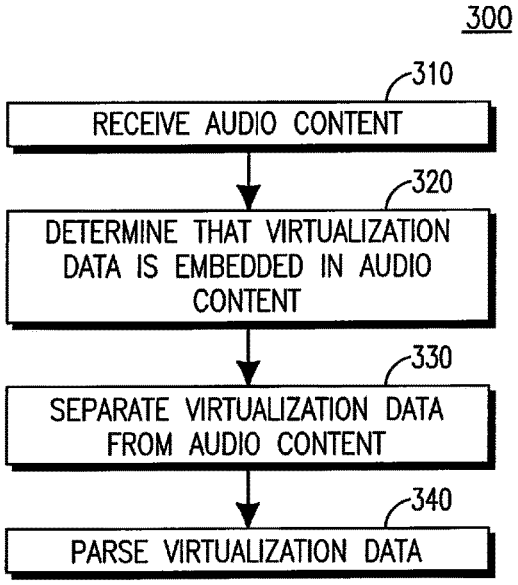
FIG. 3A is a diagram of an example method for use in a virtualization system applying the virtualization data to process audio content that includes embedded virtualization data.

FIG. 3A is a diagram of an example method 300 for use in a virtualization system applying the virtualization data to process audio content that includes embedded or multiplexed virtualization data. Once the virtualization system receives the audio content 310, the virtualization system may determine 320 that virtualization data is multiplexed with the audio content. The virtualization system may separate 330 the virtualization data from the audio content and parse 340 the virtualization data. The virtualization data and/or audio content may be transferred to the virtualization system via a wired and/or wireless connection.

Figure 3B:
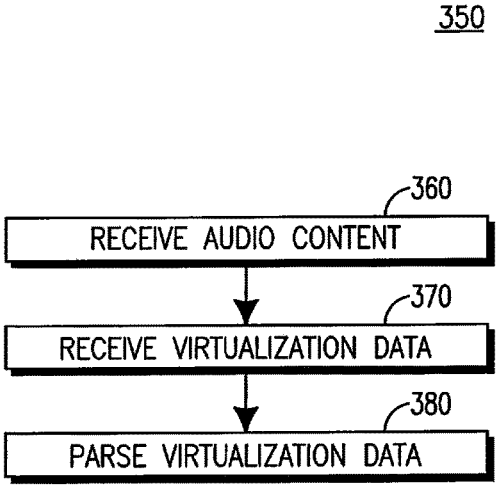
FIG. 3B is a diagram of an example method for use in a virtualization system applying virtualization data to process audio content that does not include embedded virtualization data.

FIG. 3B is a diagram of an example method 350 for use in a virtualization system applying virtualization data to process audio content that does not include embedded or multiplexed virtualization data. In this example, the virtualization system may receive the audio content 360, and separately receive the virtualization data 370. The virtualization system may then parse 380 the virtualization data. In this example, the virtualization data may be received prior to receiving the audio content, after receiving the audio content, or during reception of the audio content.

In accordance with a particular novel embodiment, the virtualization data may have a unique identifier, such as, for example, an MD5 checksum or other hash function. The virtualization system may receive the unique identifier separately from the virtualization data. The virtualization system may poll a remote server containing the unique identifier and virtualization data, or the unique identifier may be transferred to the virtualization system directly. The unique identifier may be transferred to the virtualization system intermittently, for example, in frames designated as random access points. The virtualization system may compare the unique identifier to unique identifiers of previously received virtualization data. If the unique identifier matches previously received virtualization data, then the virtualization system may use the previously received virtualization data.

If the virtualization data includes the full room measurement profiles, then the virtualization system may process the audio content by performing a direct convolution of the audio content with the room measurement profiles. If the virtualization data includes the HRTF filter coefficients, early room response parameters, and late reverberation parameters, then the virtualization system may create an acoustic model of the room and process the audio content using the acoustic model and the HRTFs. In this example, the early room response parameters and the late reverberation parameters may be convolved with the audio content.

Alternatively, the virtualization system may use a combination of direct convolution and acoustic modeling to compensate for a perceptually relevant room measurement profile that may be missing by using a reverberation algorithm that is included with the virtualization system. For example, the early room response parameters may be convolved with the audio content, while the late reverberation parameters may be modeled. In this example, the late reverberation parameters may be modeled without convolution filtering. This example may be employed in situations where the implementation resources do not allow for a full room measurement profile to be convolved. In this example, an originally measured reverberation tail may be replaced with an artificial reverb tail as part of the room measurement profile. The parameters of the reverberation may be selected so that the perceptual attributes of the original reverberation tails are reproduced as closely as possible. These parameters may be specified as part of the room measurement profile.

Additionally, in accordance with a particular embodiment, the virtualization system may track the position of the listener's head. Based on the listener's head position, the virtualization system may alter the HRTFs and/or room measurement profile to better correspond with a similar listening position in the measured room.

The virtualization system may process the audio content at the time of playback and/or prior to the time of playback. The processing of the audio content may be distributed. For example, the audio content may be pre-processed with some virtualization data, and the virtualization system may further process the audio content to correct for the hearing loss of the listener. The processing may be performed in a playback device of a user, such as, for example, an MP3 player, a mobile phone, a computer, headphones, an AV receiver, or any other device capable of processing audio content. Alternatively, in some embodiments, the processing may be performed prior to being stored in or transmitted to a user's local device. For example, the audio content may be pre-processed at a server of a content owner, and then transmitted to a user device as a spatialized headphone mix.

For example, the virtualization system may render audio content into a two channel signal with surround virtualization, and may be part of a virtualization system.

The virtualization system may be constructed in such a way as to allow for pre-processing of audio by content producers. This process may generate an optimized audio track designed to enhance device playback in a manner specified by the content producer. The virtualization system may include one or more processors configured to retain the desired attributes of the originally mixed surround soundtrack and provide to the listener the sonic experience that the studio originally provided.

Any room and speaker configuration that is intended to be used for pre-processing content may be measured and stored in a virtualization file format. Since this model may assume that pre-processing will not be performed in real-time, the pre-encoded content model may provide the ability to emulate any space with the full room measurement profile. The virtualization file format may include information on how the signal was pre-processed, if the signal was pre-processed. For example, the virtualization file format may include full or partial information related to a room measurement profile, an accessory device profile, a playback device profile, and/or a listener hearing profile.

The result of pre-processing with the virtualization system may be a bit stream that may be decoded using any decoder. The bit stream may include a flag that indicates whether or not the audio has been pre-processed with virtualization data. If the bit steam is played back using a legacy decoder that does not recognize this flag, the content may still play with the virtualization system, however, a Headphone EQ may not be included in that processing. A Headphone EQ may include an equalization filter that approximately normalizes the frequency response of a particular headphone.

The playback device or accessory device may contain the virtualization system configured to render an audio signal that has been pre-processed with the virtualization data. When the playback device or accessory device receives an audio signal, it may look for a consumer device flag in the bit stream. In this example, the consumer device flag may be a headphone device flag. If the headphone flag is set, the binaural room and reverberation processing blocks may be bypassed and only the Headphone EQ processing may be applied. Spatial processing may be applied to those signals that do not have the headphone flag set.

The audio content may be processed in the mixing studio, allowing the audio producer to monitor the spatialized headphone mix the end-user hears. When the processed or pre-processed audio content is played back over headphones, for example, the audio content sounds similar to audio played back over the loudspeakers in the measured listening environment.

Processing Content at Run-Time

When the virtualization data is intended for real-time use, a run-time data format may be used. The run-time data format may include a simplified room measurement profile that may be executed quickly and/or with less processor load. This is in contrast to the room measurement profile that would be used with pre-processed audio, where execution speed and processor load is less important. The run-time data format may be a representation of the room measurement profile with one or more shortened convolution filters that are more suitable to processing limitations of the playback device and/or accessory device. The virtualization system may compensate for a perceptually relevant room measurement profile that may be missing by using a reverberation algorithm that is included with the virtualization system.

If the audio source stream is not pre-processed with virtualization data, the run-time data format may be obtained from "preset" files that may be stored locally. The run-time data format may include a room measurement profile measured by a consumer and/or a room measurement profile from a different source (e.g. a remote server).

The run-time data format may also be embedded or multiplexed in the stream as metadata. In this example, the run-time metadata is parsed and sent to the real-time algorithm running on the device. This feature may be useful in gaming applications, as providing a room measurement profile in this manner may permit the content provider to define the virtual room acoustics that should be used when processing the audio in real time for a particular game. In this example, the relevant room measurement profile may be passed to one or more external devices, for example a gaming peripheral, by transcoding the multichannel soundtrack of the game as a multichannel stream with an embedded room measurement profile that may be used on the external device.

In accordance with a particular novel embodiment, the virtualization system may use data measured in the current room using similar virtualization data and post processing techniques described above in order to render the acoustics of the local listening environment over headphones.

If the virtualization data included multiple rooms' measurements, then the virtualization system may select which room's acoustics should be used for processing the audio content. A user may prefer audio content that is processed with a room measurement profile that is most similar to the acoustics of the current room. The virtualization system may determine some measure of the current room's acoustics with one or more tests. For example, a user may clap their hands in the current room. The hand clap may be recorded by the virtualization system, and then processed to determine the acoustic parameters of the room. Alternatively or in addition, the virtualization system may analyze other environmental sounds such as speech.

Once the virtualization system has determined the acoustic parameters of the current room, the virtualization system may select and/or adapt a measured room's acoustics. In accordance with a particular embodiment, the virtualization system may select the measured room with acoustics most similar to the current room. The virtualization system may determine the most similar measured room by correlating the acoustic parameters of the current room with acoustic parameters of the measured room. For example, the acoustic parameters of the hand clap in the current room may be correlated with the acoustic parameters of a real or simulated hand clap in the measured room.

Alternatively or in addition, in accordance with a particular embodiment, the virtualization system may adapt the acoustic model of the measured room to be more similar to the current room. For example, the virtualization system may filter or time scale the early response of the measured room to be more similar to the current room's early response. The virtualization system may also use the current room's early response. The virtualization system may also use the current room's reverberation parameters in the measured room's late reverberation model.

When the processed audio content is played through the headphones, the processed audio content may approximate the timbre of the measured loudspeakers together with the acoustic character of the measured room. However, the listener may be accustomed to the timbre of the headphones, and the difference in timbre between an unprocessed or "downmixed" headphone signal and the loudspeakers and acoustic character of the measured room may be noticeable to the listener. Therefore, in accordance with a particular novel embodiment, the virtualization system may neutralize the timbre differences with respect to specific input channels and/or input channel pairs, while preserving the spatial attributes of the loudspeakers in the measured room. The virtualization system may neutralize the timbre differences by applying an equalization that yields an overall timbre signature that more closely approximates the timbre of the original headphone signal that the listener is accustomed to hearing. The equalization may be based on the frequency response of specific playback headphones and/or the HRTFs and acoustic model of the measured room.

In accordance with a particular embodiment, the listener may select between different equalization profiles. For example, the listener may select a room measurement profile that approximates the exact timbre and spatial attributes of the original production as played in the measured room. Or the listener may select an accessory device profile that neutralizes the timbre differences while maintaining the spatial attributes of the original production. Or the listener may select from a combination of these or other equalization profiles.

In accordance with another particular embodiment, the listener and/or virtualization system may additionally select between different HRTF profiles, if the listener's specific HRTFs are not known. The listener may select an HRTF profile through listening tests or the virtualization system may select an HRTF profile through other means. The listening tests may include different sets of HRTFs, and allow the listener to select the set of HRTFs with a preferred localization of the test sounds. The HRTFs used in the original room measurement profile may be replaced and the selected set of HRTFs may be integrated such that the acoustic characteristics of the original measurement space are preserved.

Listener Hearing Profile

Figure 4:
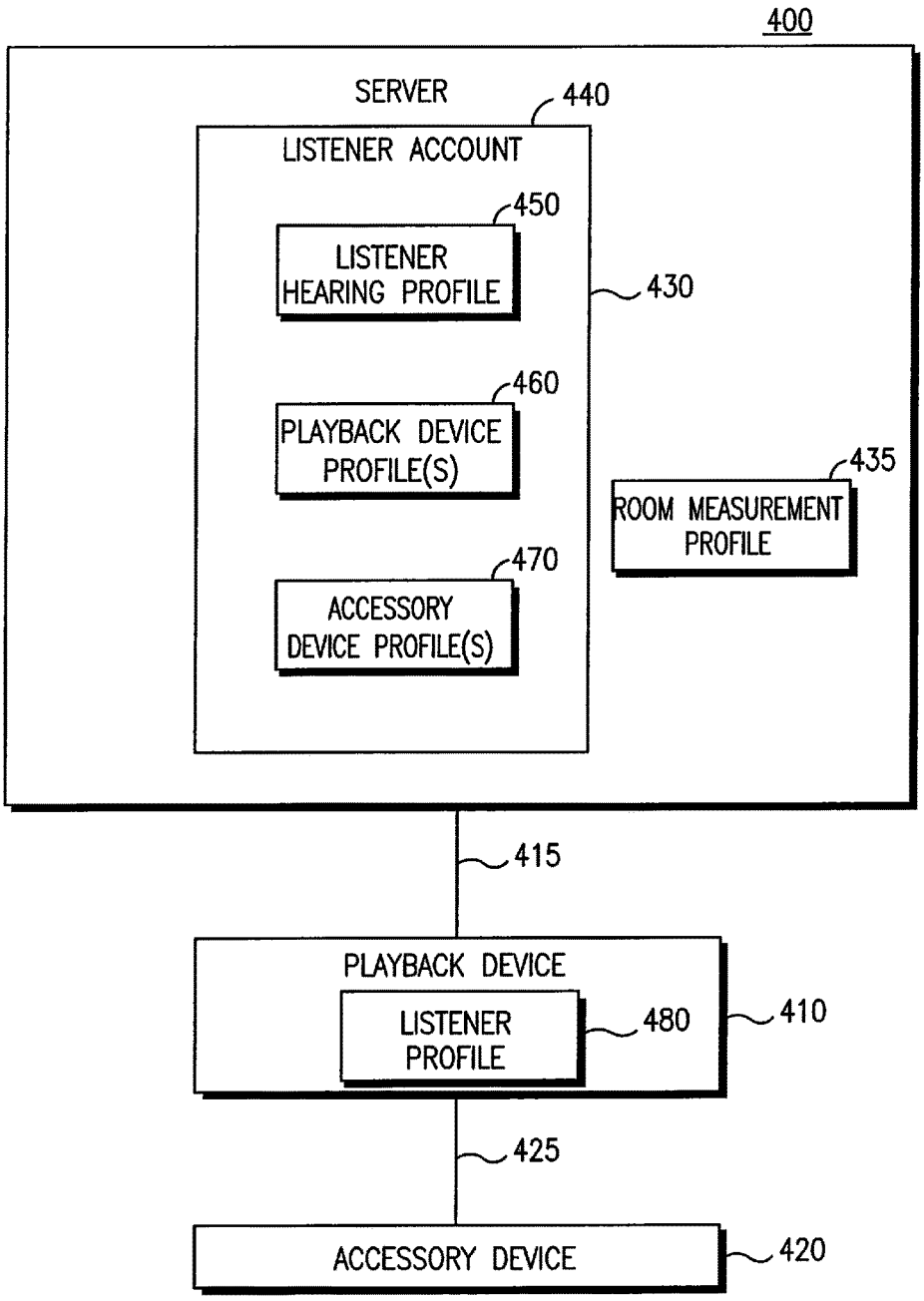
FIG. 4 is a diagram of an example virtualization system.

FIG. 4 is a diagram of an example virtualization system 400. The virtualization system 400 may include one or more local playback devices 410 of the user, one or more accessory devices 420, and a server 430. The server 430 may be a local server or a remote server. The server 430 may include one or more room measurement profiles 435. The one or more room measurement profiles 435 may be included in a unique listener account 440. A user may be associated with a unique listener account 440 of the virtualization system 400. The playback device 410 may communicate with the server 430 via a wired or wireless interface 415, and may communicate with the accessory device 420 via a wired or wireless interface 425. The listener account 440 may include information about the user, such as one or more listener hearing profiles 450, one or more playback device profiles 460, and one or more accessory device profiles 470. The one or more room measurement profiles 435 and the one or more profiles from the listener account 440 may be transmitted to the playback device 410 and/or the accessory device 420 for use and storage. The one or more room measurement profiles 435 and the one or more profiles from the listener account 440 may be transmitted as embedded metadata in an audio signal, or they may be transmitted separately from the audio signal.

The listener hearing profile 450 may be generated from the results of a listener hearing test. The listener hearing test may be performed with a playback device of the user, such as a smart phone, computer, personal audio player, MP3 player, A/V receiver, television, or any other device capable of playing audio and receiving user input. Alternatively, the listener hearing test may be performed on a standalone system that may upload the hearing test results to the server 430 for later use with the playback device 410 of the user. In accordance with a particular embodiment, the listener hearing test may occur after the user is associated with the unique listener account 440. Alternatively, the listener hearing test may occur before the user is associated with the unique listener account 440, and then may be associated with the listener account 440 at some time after completing the test.

In accordance with a particular embodiment, the virtualization system 400 may obtain information about the playback device 410, the accessory device 420, and the room measurement profile 435 that will be used with the listener hearing test. This information may be obtained prior to the listener hearing test, concurrently with the listener hearing test, or after the listener hearing test. The playback device 410 may send a playback device identification number to the server 430. Based on the playback device identification number, the server 430 may look up the make/model of the playback device 410, the audio characteristics of the playback device 410, such as frequency response, maximum volume level, and minimum volume level, and/or the room measurement profile 435. Alternatively, the playback device 410 may directly send the make/model of the playback device and/or the audio characteristics of the playback device 410 to the server 430. Based on the make/model of the playback device 410, the audio characteristics of the playback device 410, and/or the room measurement profile 435, the server 430 may generate a playback device profile 460 for that particular playback device 410.

In addition, the playback device 410 may send information about the accessory device 420 connected to the playback device 410. The accessory device 420 may be headphones, headset, integrated speakers, standalone speakers, or any other device capable of reproducing audio. The playback device 410 may identify the accessory device 420 through user input, or automatically by detecting the make/model of the accessory device 420. The user input of the accessory device 420 may include a user selection of the specific make/model of the accessory device 420, or a user selection of a general category of accessory device, such as in-ear headphone, over-ear headphone, earbuds, on-ear headphone, built-in speakers, or external speakers. The playback device 410 may then send an accessory device identification number to the server 430. Based on the accessory device identification number, the server 430 may look up the device make/model of the accessory device 420, the audio characteristics of the accessory device 420, such as frequency response, harmonic distortion, maximum volume level, and minimum volume level, and/or the room measurement profile 435. Alternatively, the playback device 410 may directly send the make/model of the accessory device 420 and/or the audio characteristics of the accessory device 420 to the server 430. Based on the make/model of the accessory device 420, the audio characteristics of the accessory device 420, and/or the room measurement profile 435, the server 430 may generate an accessory device profile 470 for the particular accessory device 420.

The listener hearing test may be performed with the playback device 410 of the user and the accessory device 420 connected to the playback device 410. The listener hearing test may determine the hearing characteristics of the user, such as minimum loudness thresholds, maximum loudness thresholds, equal loudness curves, and HRTFs, and the virtualization system may use the hearing characteristics of the user in rendering the headphone output. In addition, the listener hearing test may determine the equalization preferences of the user, such as a preferred amount of volume in the bass, mid, and treble frequencies. The listener hearing test may be performed by the playback device 410 playing a series of tones over the accessory device 420. The series of tones may be played at a variety of frequencies and loudness levels. The user may then input to the playback device 410 whether they were able to hear the tones, and the minimum loudness level that the tones were heard by the user. Based on the input of the user, the hearing characteristics of the user may be determined for the particular playback device 410 and accessory device 420 used for the test. The playback device 410 may transmit the results of the listener hearing test to the server 430. The listener hearing test results may include the specific hearing characteristics of the user, or the raw user input data that was generated during the listener hearing test. In addition, the listener hearing test results may include equalization preferences for the particular playback device 410 and output speakers used during the test. The room measurement profile 435, accessory device profile 470, and/or playback device profile 460 may be updated based on the listener hearing test results.

After the server 430 obtains the hearing test results, playback device profile 460, and accessory device profile 470, the server 430 may generate a listener hearing profile 450. The listener hearing profile 450 may be generated by removing the audio characteristics of the playback device 410 and accessory device 420 from the hearing test results. In this manner, a listener hearing profile 450 may be generated that is independent of the playback device 410 and accessory device 420.

In some embodiments, components of the virtualization system 400 may reside on the server 430 in a cloud computing environment. The cloud computing environment may deliver computing resources as a service over a network between the server 430 and any of the registered playback devices.

Once a listener hearing profile 450 has been generated for the user, the server 430 may transmit the listener hearing profile 450 to each of the playback devices 410 registered with the system. In this manner, each of the playback devices 410 may store a listener profile 780 that is synchronized with the current listener hearing profile 450 on the server 430. This may allow the user to experience a rich personalized playback experience on any of the registered playback devices of the user. Irrespective of which of the registered devices of the user are used as the playback device 410, the listener profile 480 contained on the playback device 410 may optimize the playback experience for the listener on that device.

Once the user requests audio content from the system and attempts playback of the content, the playback device 410 being used to playback the content may check to determine whether the user has a valid playback session. A valid playback session may mean that the user is logged into the system and the system knows the identity of the user and the type of playback device being used. Moreover, this may also mean that a copy of the listener profile 480 may be contained on the playback device 410. If no valid session exists, then the playback device 410 may communicate with the server 430 and validate the session with the system using the user identification, playback device identification, and any available accessory device information.

The virtualization system 400 may adapt the playback device profile 460 and accessory device profile 470 (if any) based on the listener hearing profile 450. In other words, using the listener hearing profile 450 as the benchmark of how the user wants to hear the audio content, the system may configure the playback device profile 460 and the accessory device profiles 470 of any connected accessory devices to come as close as possible to achieving that benchmark. This information may be transmitted from the server 430 to the playback device 410, prior to the playback of the audio content, and stored at the playback device 410.

The playback of the audio content may then commence on the playback device 410 based on the listener hearing profile 450, the playback device profile 460, and the accessory device profile 470. At various intervals, the server 430 may query the playback device 410 for any state changes (such as accessory device change when new headphones are connected). Alternatively, the playback device 410 may notify the virtualization system 400 that a state change has occurred. Or it may be that the user has updated her preferences or retaken the listener hearing test. Whenever one of these changes occurs, an update module of the system may provide the playback device with all or some of the following: 1) an updated listener profile; 2) a playback device profile for the playback device currently being used; and 3) an accessory device profile for any accessories being used in connection with the playback.

It should be noted that the profiles may be stored by the virtualization system in case they are needed in the future. Even if the playback device is no longer used or an accessory device is disconnected from the playback device, the profiles may be stored by any component of the virtualization system. In some embodiments, the virtualization system may also track the number of times the user uses a playback device or an accessory device. This may allow the virtualization system to provide a customized recommendation to the user based on prior playback device and accessory device usage.

In some embodiments, the virtualization system may be notified of which playback devices and accessory devices are being used. In some examples, the virtualization system may be notified of which playback devices and accessory devices are being used without user input. There may be several options to implement the notification, for example, using radio frequency identification (RFID) and plug and play technology. Thus, even if the user makes a mistake about which playback device or accessory device is being used, the virtualization system may determine the correct playback device profile and accessory device profile to use.

In some embodiments, the listener profile may be associated with the user without the use of a listener hearing test. This may be accomplished by mining a database of listener hearing tests that have been taken previously and correlating them with the identification of users that completed the tests. Based on what the system knows about the user, the system may assign a listener profile from the database that most closely matches the characteristics of the user (such as age, sex, height, weight, and so forth).

Embodiments of the virtualization system may allow an entity, such as an original equipment manufacturer (OEM), to change factory settings of a playback device. In particular, the OEM may perform tuning of the audio characteristics of the playback device at the factory. The ability to adjust these factory settings typically is limited or nonexistent. Using the virtualization system, the OEM may make changes to the playback device profile to reflect the desired changes in the factory settings. This updated playback device profile may be transmitted from the server to the playback device and permanently stored thereon.

If multiple registered users are using a single playback device and accessory device (such as listening to speakers in a room together), the virtualization system may determine optimal playback settings for multiple users. For example, the system may average the listener profiles of the multiple users.

Figure 5:
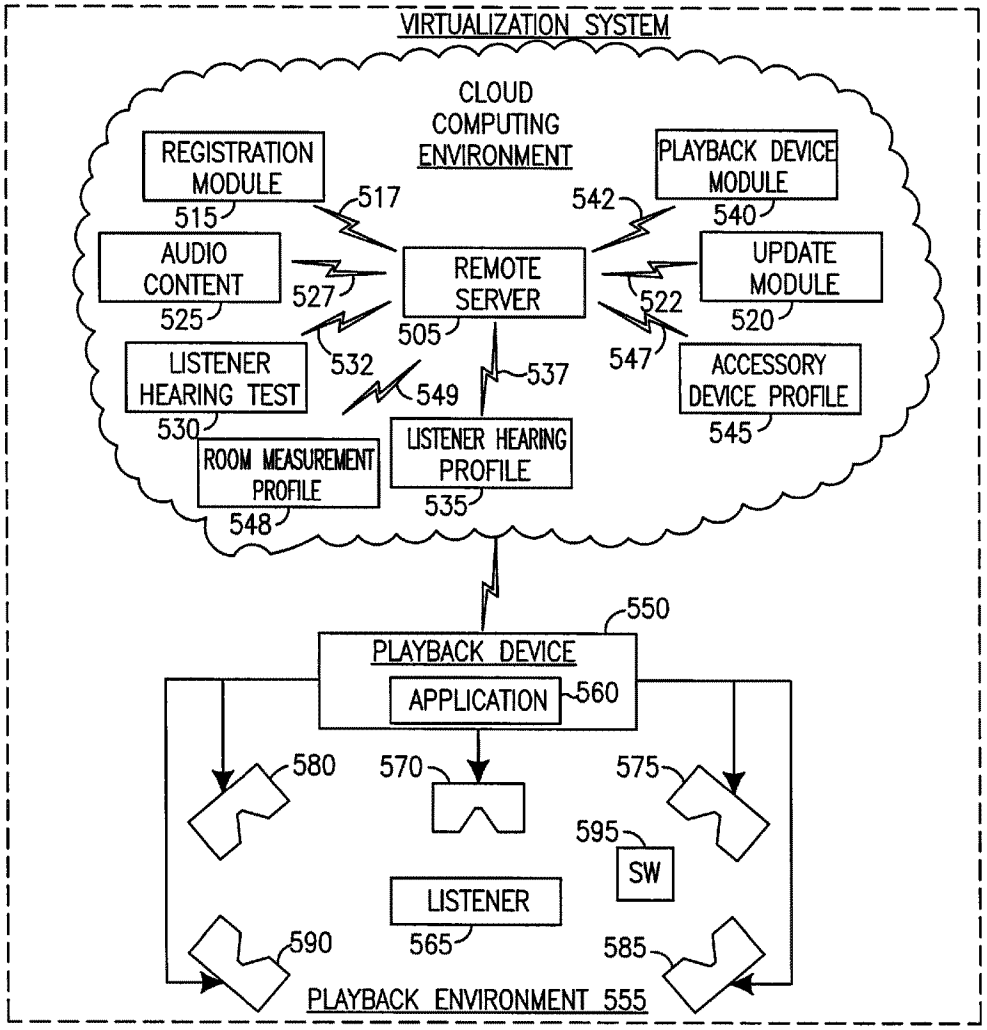
FIG. 5 is a block diagram illustrating an overview of the virtualization system.

FIG. 5 is a block diagram illustrating an overview of an example virtualization system 500. It should be noted that FIG. 5 is one of many ways in which the embodiments of the virtualization system 500 may be implemented. Referring to FIG. 5, the example virtualization system 500 may include a remote server 505 that may be contained within a cloud computing environment 510. The cloud computing environment 510 may be a distributed environment with both hardware and software resources distributed amongst various devices. Several components of the virtualization system 500 may be distributed in the cloud computing environment 510 and in communication with the remote server 505. In alternate embodiments, at least one or more of the following components may be contained on the remote server 505.

In particular, the virtualization system 500 may include a registration module 515 in communication with the remote server 505 through a first network link 517. The registration module 515 may facilitate registration of users, devices, and other information (such as playback environment) with the virtualization system 500. An update module 520 may be in communication with the remote server 505 through a second communication link 522. The update module 520 may receive updates in user and device status and send queries to determine user and device status. If the update module 520 becomes aware of a status or state change, then any necessary profiles may be updated. The virtualization system 500 may include audio content 525 in communication with the remote server 505 through a third communication link 527. This audio content 525 may be selected by the user and sent by the remote server 505.

A listener hearing test 530 for a user to take on a device may be stored in the cloud computing environment 510 and may be in communication with the remote server 505 through a fourth communication link 532. In some embodiments, the listener hearing test 530 may be a plurality of different tests. As noted above, the user may take the listener hearing test 530 on a device, and the results may be uploaded to the remote server 505 where the virtualization system 500 may generate a listener profile 535. The listener profile 535 may be device agnostic, meaning that the same audio content played on different playback devices may sound virtually the same. The listener profile 535 for each registered user may be stored in the cloud computing environment 510 and may be in communication with the remote server 505 through a fifth communication link 537.

Based on the listener profile 535 for a particular registered user, the virtualization system 500 may generate a playback device profile 540 that may be based on the type of device the user is using to playback any audio content 525. In some embodiments, the playback device profile 540 may be a plurality of profiles stored for a plurality of different playback devices. The playback device profile 540 may be in communication with the remote server 505 through a sixth communication link 542. Moreover, the virtualization system 500 may generate an accessory device profile 545 for any type of accessory device that the user is using. In some embodiments, the accessory device profile 545 may be a plurality of profiles that are stored for a variety of different accessory devices. The accessory device profile 545 may be in communication with the remote server 505 through a seventh communication link 547.

The virtualization system 500 may include a room measurement profile 548 that may be in communication with the remote server 505 through an eighth communication link 549. It should be noted that one or more of the communication links 517, 522, 527, 532, 537, 542, 547 and/or 549 discussed above may be shared.

Embodiments of the virtualization system 500 may also include a playback device 550 for playing back audio content 525 in a playback environment 555. The playback environment 555 may be virtually anywhere the audio content can 525 can be enjoyed, such as a room, car, or building. The user may take the listener hearing test 530 on a device and the results may be sent to the remote server 505 for processing by the virtualization system 500. In some embodiments of the virtualization system 500, the user may use an application 560 to take the listener hearing test 530. In FIG. 5, the application 560 is shown on the playback device 550 for ease in describing the virtualization system 500, but it should be noted that the device on which the listener hearing test 530 was taken may not necessarily be the same device as the playback device 550. The virtualization system 500 may generate the listener profile 535 from the results of the listener hearing test 530 and transmit the listener profile 535 to all registered devices associated with the user.

Playback of the audio content 525 to a listener 565 may take place in the playback environment 555. In the exemplary embodiment shown in FIG. 5, a 5.1 loudspeaker configuration is shown in the playback environment 555. It will be appreciated that any one of numerous audio configurations may be used in the playback environment, including headphones. As shown in FIG. 5, the 5.1 loudspeaker configuration may include a center loudspeaker 570, right front loudspeaker 575, a left front loudspeaker 580, a right rear loudspeaker 585, a left rear loudspeaker 590, and a subwoofer 595. The playback device 550 may communicate with the remote server 505 over an eighth communication link 597.

Figure 6A:
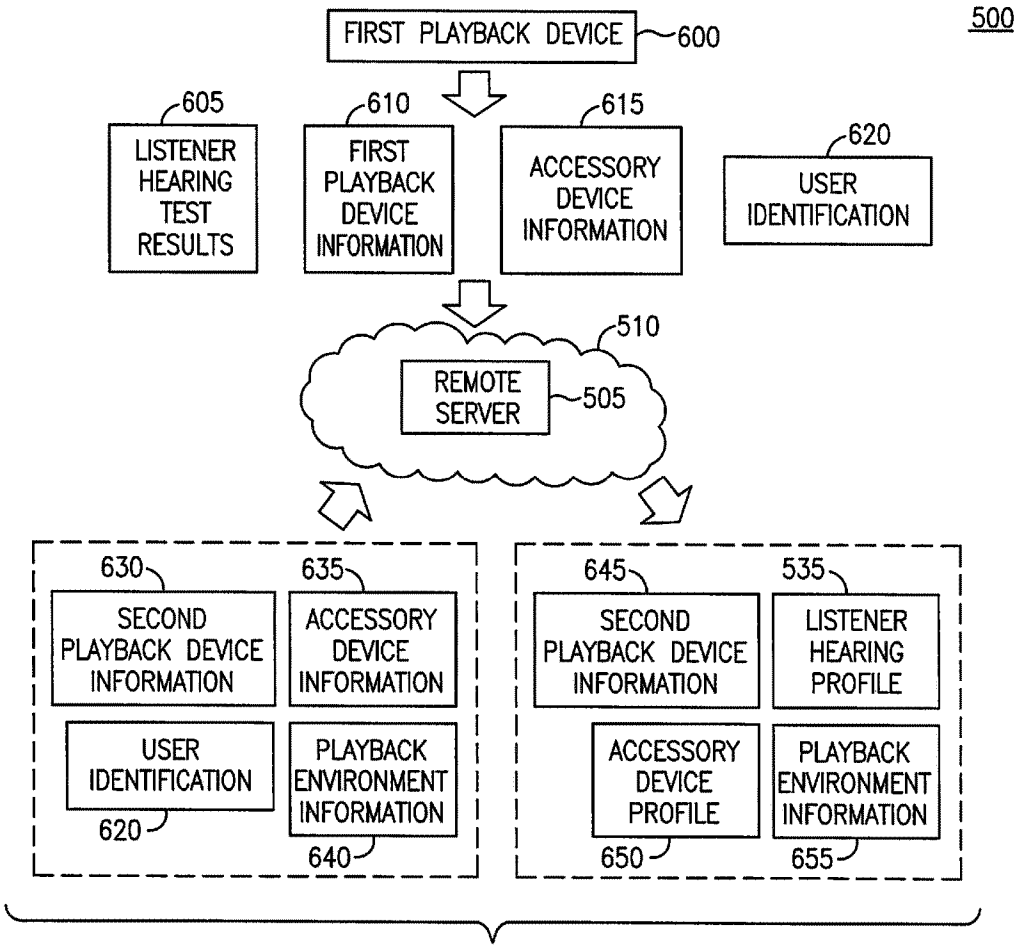
FIGS. 6A and 6B are a block diagram illustrating a general overview of the operation of embodiments of the virtualization system of FIG. 5.
Figure 6B:
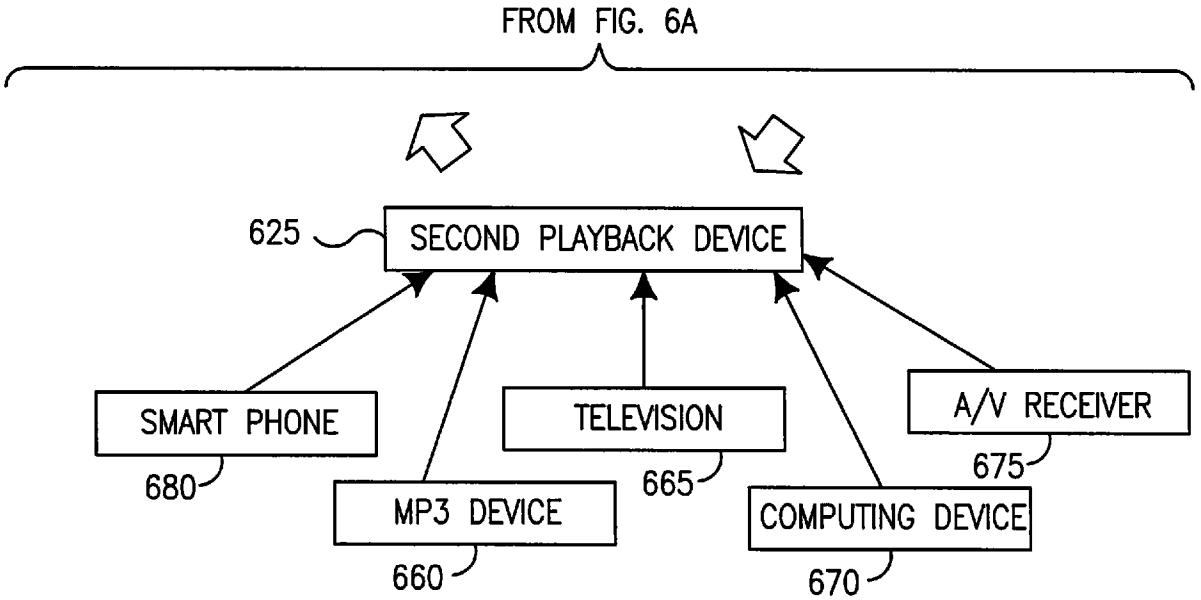

FIGS. 6A and 6B are a block diagram illustrating a general overview of the operation of embodiments of the virtualization system 500. For example, a first playback device 600 may be used to take the listener hearing test 530. In some embodiments, the first playback device 600 may contain the application 560 for facilitating the taking of the listener hearing test 530. Once the user completes the listener hearing test 530, listener hearing test results 605 may be sent to the remote server 505. In addition, the first playback device 600 may send first playback device information 610, accessory device information 615 (such as type of loudspeakers or headphones connected to the first playback device 600), and the user identification to the remote server 505.

A second playback device 625 may be used to playback the audio content 525 for the listener 565. Once again, although the first playback device 600 and the second playback device 625 are shown as separate devices, in some embodiments they may be the same device. Prior to playback, the second playback device 625 may send information such as the user identification 620, second playback device information 630, accessory device information 635, and playback environment information 640 to the remote server 505. The virtualization system 500 on the remote server 505 may process this information from the second playback device 625 and transmit information back to the second playback device 625. The information transmitted back to the second playback device 625 may be profiling information, such as the listener profile 535, a second playback device profile 645, an accessory device profile 650, and a playback environment profile 655. Using one or more of these profiles 535, 645, 650, or 655, the second playback device 625 may play back the audio content 525 to the listener 565.

The second playback device 625 may be any one of a number of different types of playback devices having network connectivity. By way of example and not limitation, the second playback device 625 may be an MP3 device 660, a television 665, a computing device 670, an AN receiver 675, or an embedded device such as a smartphone 680. Using embodiments of the virtualization system 500, the listener 565 may listen to the same audio content using different types of playback devices, accessory devices, and in various playback environments and have a substantially similar audio experience.

Figure 7:
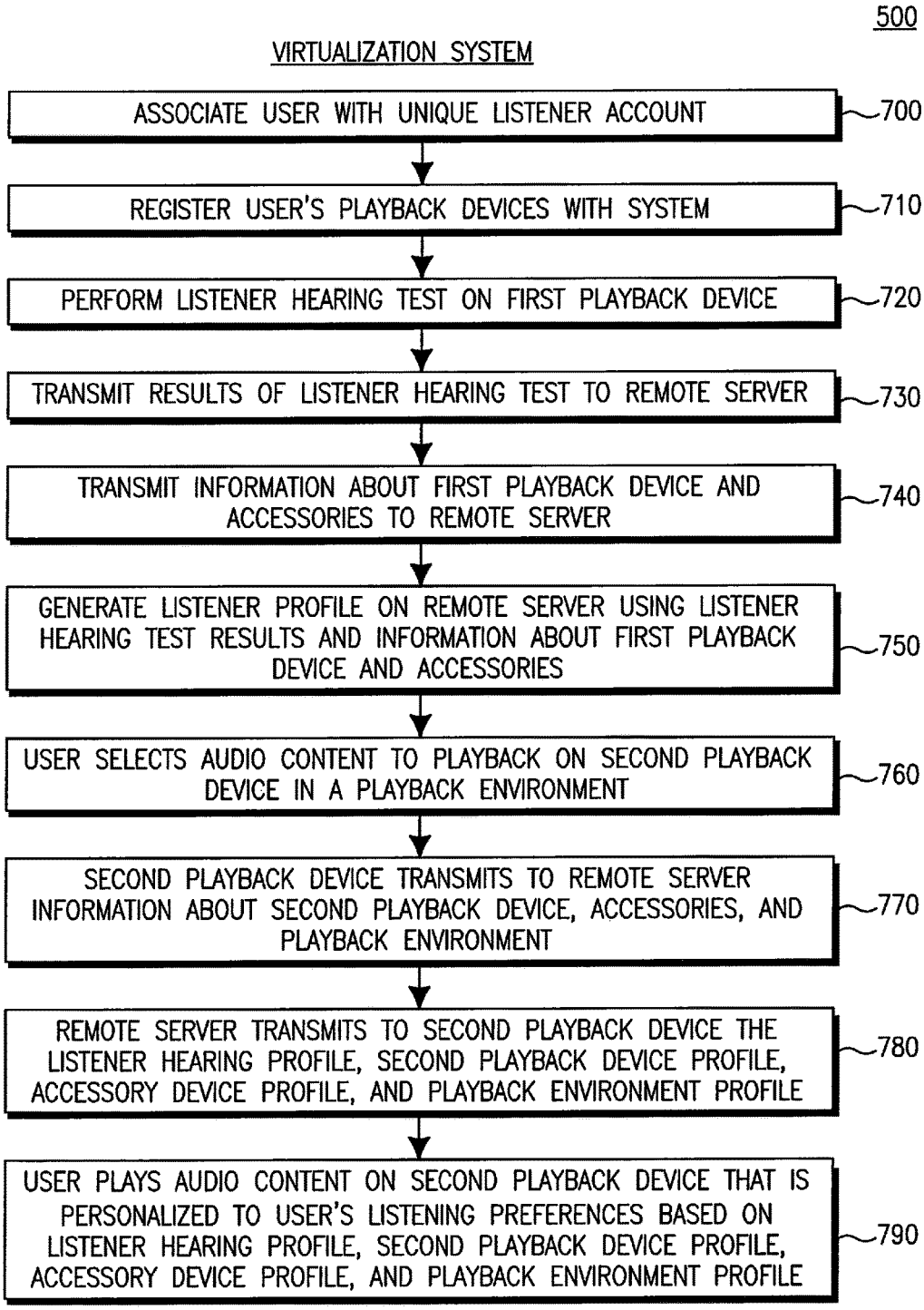
FIG. 7 is a detailed flow diagram illustrating an example method described for use in a virtualization system.

FIG. 7 is a flow diagram of an example method for use in a virtualization system. The method may begin by associating a user with a unique listener account 700. This information may be stored in the cloud computing environment 510. Moreover, each of the user's playback devices may be registered with the virtualization system 500 and stored 710 in the cloud computing environment 510.

As described above, the user may perform 720 a listener hearing test 530 on the first playback device 600. Moreover, information about the first playback device 600 and any accessory devices used with the first playback device 600 may be transmitted 740 to the remote server 505. Using this information, embodiments of the virtualization system 500 may generate 750 the listener profile 535 for the user on the remote server 505.

The user may select 760 the audio content 525 to playback on the second playback device 625 in the playback environment 555. The second playback device 625 may transmit 770 information about the second playback device 625 (such as model number), information about any accessory devices (such as brand and/or type), and information about the playback environment 555 (such as room characteristics and loudspeaker placement to the remote server 505. In some embodiments, the devices may only need to register once with the virtualization system 500 and may be given a device identification upon registration. Further interaction with the virtualization system 500 may require that the device provide its device identification.

The remote server 505 may then transmit 780 the listener profile 535, second playback device profile 645, accessory device profile 650, and the playback environment profile 655 to the second playback device 625. In some embodiments, any one or any combination of these profiles may be transmitted. In some embodiments, certain profiles may not apply, and in other embodiments, the profile may be stored locally on the second playback device 625. Using these profiles, the user may play 790 the audio content 525 on the second playback device 625. The playback of the audio content 525 may be personalized to the user listening preferences based on the listener profile 535 and other profiles such as the second playback device profile 645, the accessory device profile 650, and the playback environment profile 655.

The particulars shown herein are by way of example and for purposes of illustrative discussion of the embodiments of the present invention only, and are presented in the case of providing what is believed to be the most useful and readily understood description of the principles and conceptual aspects of the present invention. In this regard, no attempt is made to show particulars of the present invention in more detail than necessary for the fundamental understanding of the present invention, the description taken with the drawings make apparent to those skilled in the art how the several forms of the present invention may be embodied in practice.

What is claimed is:

1. A method for use in an audio device, the method comprising:

receiving, by the audio device, digital audio content that contains at least one audio channel signal;

transmitting information identifying the audio device to a server;

receiving, from the server, a device profile based on a frequency response parameter of a device;

accessing a room measurement profile based on acoustic measurements of a predetermined room;

accessing a listener hearing profile based on a spectral response curve of a user hearing ability;

configuring at least one digital filter based on said device profile, said room measurement profile and said listener hearing profile;

filtering the at least one audio channel with the corresponding at least one digital filter to produce a filtered audio signal; and outputting the filtered audio signal to an accessory device coupled to the audio device to reproduce the digital audio content.

2. The method of claim 1, wherein the device profile is based on one or both of a frequency response parameter of a playback device and a frequency response parameter of an accessory device.

3. The method of claim 1, wherein one or more of the room measurement profile, listener hearing profile, and device profile is received as metadata that is multiplexed with the digital audio content.

4. The method of claim 1, wherein one or more of the room measurement profile, listener hearing profile, and device profile is received as metadata in a container file separately from the digital audio content.

5. The method of claim 1, wherein the digital audio content is received as an audio source stream.

6. The method of claim 1, wherein the room measurement profile includes at least a set of head-related transfer function (HRTF) filter coefficients, an early room response parameter, and a late reverberation parameter.

7. The method of claim 6, wherein the early room response parameter and the late reverberation parameter configure the digital filter to produce a filtered audio signal having acoustic properties substantially similar to the acoustic properties of the predetermined room.

8. The method of claim 7, wherein the late reverberation parameter configures a parametric model of the late reverberation of the predetermined room.

9. The method of claim 1, wherein the step of accessing a room measurement profile includes selecting a room measurement profile based on an acoustic parameter or architectural characteristic of a user's current environment.

10. The method of claim 9, wherein the selected room measurement profile is adapted based on an acoustic parameter or architectural characteristic of a user's current environment.

11. The method of claim 10, wherein the selected room measurement profile is adapted by time scaling an early response parameter of the predetermined room.

12. The method of claim 10, wherein the selected room measurement profile is adapted by filtering an early response parameter of the predetermined room.

13. The method of claim 1, wherein the step of accessing a room measurement profile is based on a user selected equalization profile.

14. The method of claim 1, wherein the room measurement profile includes at least a set of head-related transfer function (HRTF) filter coefficients, and wherein the step of accessing a room measurement profile is based on a user selected set of said HRTF filter coefficients.

15. The method of claim 14, wherein the user selected set of HRTF filter coefficients is based on a listening test.

16. An audio device comprising:

an interface configured to receive digital audio content that contains at least one audio channel signal;

transmit information identifying the audio device to a server; and receive from the server a device profile that influences the reproduction of the digital audio content; and a processor configured to access a room measurement profile based on acoustic measurements of a predetermined room and a listener hearing profile based on a spectral response curve of a user hearing ability; and configure at least one digital filter based on the device profile, room measurement profile, and listener hearing profile, wherein the processor is configured to filter the at least one audio channel signal with the corresponding at least one digital filter to produce a filtered audio signal;

wherein the processor is configured to output the filtered audio signal to an accessory device coupled to the audio device to reproduce the digital audio content.

17. The audio device of claim 16, wherein the device profile is based on one or both of a frequency response parameter of a playback device and a frequency response parameter of an accessory device.

18. The audio device of claim 16, wherein one or more of the room measurement profile, listener hearing profile, and device profile is received as metadata that is multiplexed with the digital audio content.

19. The audio device of claim 16, wherein one or more of the room measurement profile, listener hearing profile, and device profile is received as metadata in a container file separately from the digital audio content.

20. The audio device of claim 16, wherein the digital audio content is received as an audio source stream.

21. The audio device of claim 16, wherein the room measurement profile includes at least a set of head-related transfer function (HRTF) filter coefficients, an early room response parameter, and a late reverberation parameter.

22. The audio device of claim 21, wherein the early room response parameter and the late reverberation parameter configure the digital filter to produce a filtered audio signal having acoustic properties substantially similar to the acoustic properties of the predetermined room.

23. The audio device of claim 22, wherein the late reverberation parameter configures a parametric model of the late reverberation of the predetermined room.

24. The audio device of claim 16, wherein the step of accessing a room measurement profile includes selecting a room measurement profile based on an acoustic parameter or architectural characteristic of a user's current environment.

25. The audio device of claim 24, wherein the selected room measurement profile is adapted based on an acoustic parameter or architectural characteristic of a user's current environment.

26. The audio device of claim 25, wherein the selected room measurement profile is adapted by time scaling an early response parameter of the predetermined room.

27. The audio device of claim 25, wherein the selected room measurement profile is adapted by filtering an early response parameter of the predetermined room.

28. The audio device of claim 16, wherein the step of accessing a room measurement profile is based on a user selected equalization profile.

29. The audio device of claim 16, wherein the room measurement profile includes at least a set of head-related transfer function (HRTF) filter coefficients, and wherein the step of accessing a room measurement profile is based on a user selected set of said HRTF filter coefficients.

30. The audio device of claim 29, wherein the user selected set of HRTF filter coefficients is based on a listening test.

* * * * *